United States Patent [19]

Walker

[11] 4,364,037

[45] Dec. 14, 1982

[54] TRANSITION DATA IMAGE PROCESSOR

[75] Inventor: James T. Walker, Palo Alto, Calif.

[73] Assignee: Cromemco Inc., Mountain View, Calif.

[21] Appl. No.: 274,036

[22] Filed: Jun. 15, 1981

[51] Int. Cl.[3] ..... G09G 1/16

[52] U.S. Cl. ..... 340/744; 340/703; 340/728; 340/799; 358/133

[58] Field of Search ..... 358/11, 81, 133; 340/703, 728, 744

[56] References Cited

U.S. PATENT DOCUMENTS

| | | | |
|---|---|---|---|
| 3,944,997 | 3/1976 | Swallow | 340/703 X |
| 4,121,283 | 10/1978 | Walker | 340/703 X |
| 4,125,873 | 11/1978 | Chesarek | 358/133 X |
| 4,155,095 | 5/1979 | Kirschner | 358/82 |
| 4,183,046 | 1/1980 | Dalke et al. | 358/81 X |

*Primary Examiner*—David L. Trafton
*Attorney, Agent, or Firm*—Paul Hentzel

[57] ABSTRACT

Edge data codes forming an image to be displayed are entered into a random access memory map at addresses corresponding to the scanline number and pixel number of the edge in the display of the image. The edge codes may be entered into the memory map in any sequence (i.e. the sequence of availability, the sequence of generation, or the sequence of display). The addresses in the map which do not receive edge codes, are filled with zeros. The edge codes are retrieved form the map in display order to form a pixel data stream which in sequentially decoded by a look-up table and advanced through a pipeline latch for providing color and intensity control voltages to a D/A converter. Clocked pulses through a timing gate advance each new decoded edge code into the latch. The zeros between the edge codes are detected and disable the timing gate during the non-transition period between edge codes. Each edge code remains latched during the non-transition period between transitions causing the continuous display thereof during the non-transition period. Predetermined non-zero codes may be separately detected to provide formating control voltages which control other display features such as resolution and color scales.

The subject matter of this application relates to the subject matter of U.S. patent application Ser. No. 148,964, entitled Composite Display Device for Combining Image Data and Method, filed May 12, 1980 by the present assignee.

18 Claims, 2 Drawing Figures

TRANSITION DATA IMAGE PROCESSOR

TECHNICAL FIELD

This invention relates to transition data decompression, and more particularly to data decompression in which the input transition data is entered into a RAM at address coordinates corresponding to the position of the transition within the display.

BACKGROUND

Heretofore, run length encoded transition data to be imaged had to be in the sequential order of display. Transition data in non-sequential formats (such as edge by edge or face by face) required as intermediate storage from which the transition data could be sequentially retrieved. The transition data format included a display data portion followed by a run length code specifying the number of non-transition pixels until the next transition code. As each transition code was decoded and clocked through the image processor for display, the associated run length was entered into a register and decremented by the clock pulse until expiration (run length=0). At expiration, the next transition code and run length in the input sequence was advanced for display.

SUMMARY

It is therefore an object of this invention to provide an improved transition data decompressor.

It is another object of this invention to provide transition data decompression in which the input sequence of the transition data is not required to be the display sequence.

It is a further object of this invention to provide transition data decompression in which the input transition data is entered into a RAM at an address corresponding to the display coordinates of the transition.

It is another object of this invention to provide an image processor in which each unit of transition data maintains control of the display until the next unit of transition data is retrieved.

It is another object of this inventon to provide an image processor responsive to display transition data for controlling the pixel content and the frame format.

Briefly, these and other objects of the present invention are accomplished by providing control signals to a display device from an image processing circuit in response to input transition data. Each unit of transition data corresponds to a transition in the image to be processed and displayed. Each unit has a display portion defining the change in display caused by that transition, and a position portion defining the position of that transition within the display relative to the other transitions. A position decoder, such as a RAM, receives the transition data and provides a pixel data stream containing transition display codes in display sequence. The display codes are spaced by non-transition codes which define the non-transition period therebetween. A pixel clock causes the RAM to be systematically accessed to form the data stream, and establish display synchronization between the display device and the image processing circuit. A transition decoder receives the transition display codes in the pixel data stream for providing a sequence of decoded control signals. A maintenance device receives each control signal from the decoder and maintains the control signal during the non-transition period between transitions. A non-transition code detector is responsive to the non-transition codes in the stream of pixel data for providing a non-transition signal. An advancing circuit advances the next decoded control signal at the termination of the non-transition signal, and the display receives the next transition.

BRIEF DESCRIPTION OF THE DRAWINGS

Further objects and advantages of the present imaging device, and the operation of the transition data decoder, will be apparent to those skilled in the art from the following detailed description and drawings in which.

DETAILED DESCRIPTION

Figure 1:
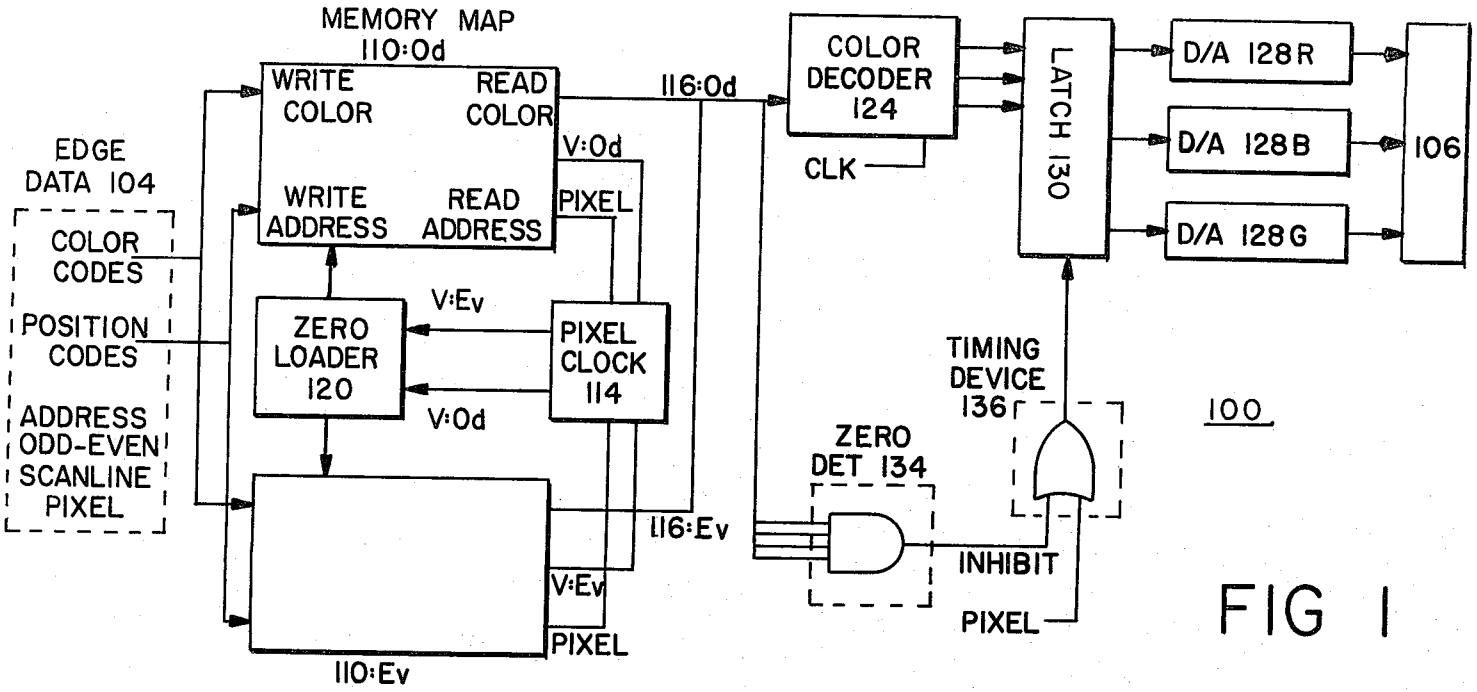
FIG. 1 is a schematic diagram of a specific embodiment of an edge decompressor imaging device showing edge data written into a memory map on a display coordinate basis.

FIG. 1 shows a specific embodiment of an image processor 100 which receives and decodes edge data 104 to form a display image on CRT 106. Each unit of edge data 104 has a pixel content code and a position code. The content code defines visual changes in the display of the pixel (such as color, intensity, etc.) initiated by the edge transition. The position code defines the vertical coordinate (scanline) and the horizontal coordinate (pixel number) of the edge transition. The content code of each transition is written into odd memory map 110:Od or even memory map 110:Ev at the address defined by the position code of that transition. The location of each content code within memories 110 corresponds to the location of that transistion as displayed on CRT 106. Edge data 104 for odd and even raster frames accumulate in memories 110 in push-pull fashion.

The pixel content code in memories 110 is accessed by a clock 114 which reads out the edge data in position decoded sequence to form odd and even pixel data streams 116:Od and 116:Ev. Odd memory 110:Od is read out to form each odd raster frame in response to a vertical sync signal (V:Od) from clock 114. Zero loader 120 is also clocked by V:Od causing all of the locations within even memory 110:Ev to return to "0" (a non-diaplay code). Edge data 104 forming the next even raster frame is written over the non-display zeros in even memory 110:Ev.

When the display of each odd frame is complete, V:Ev initiates the read out of the next even raster frame from even memory 110:Ev and returns the displayed contents of odd memory 110:Od to "0". Edge data forming the next odd raster frame accumulates within odd memory 110:Od.

Pixel streams 116:Od and 116:Ev contain spaced pixel content codes with "0"s therebetween to maintain the transition position. Each content code is detected by color decoder 124, causing a corresponding decoded control signal to advance through clocked pipeline latch 130 to D/A color converters 128R, 128G, and 128B. Latched control signals 126 from latch 130 control the display color of CRT 106. Each non-display code "0" from pixel data streams 116 is detected by zero detector 134 for establishing and maintaining an INHIBIT signal to clock timing device 136 during the non-transition spaces between color codes. Timing device 136 is disabled by INHIBIT preventing the clocked advance through latch 130. As a result, the current color code is held in latch 130 maintaining the current display color on CRT 106 during the "0" period. The next color code in stream 116 (a non-zero) flips zero detector 134, eliminating the INHIBIT signal and enabling device 136 to advance the next decoded control signal into latch 130. D/A converters 128 respond to the new latched color signal causing a corresponding transition in the video signal of CRT 106. The string of "0" codes between each pair of sequential color codes maintains the position of the transitions in CRT 106.

BEST MODE

The following particulars of are given as an illustrative example of the specific embodiment shown in FIG. 1. The electronic parts and operating parameters given below are not intended as defining the capabilities or limitations of the invention. Numerous alternative configurations are within the scope of the invention.

Edge code 104 may be 4 bits of color and intensity data on a data bus, and 16 bits of address on an address bus. The address or position portion of the edge code has a MSB segment corresponding to the raster scanline of the edge within the display, and a LSB segment corresponding to the pixel of the edge in that scanline.

CRT 106 may be a conventional, raster type, RGB monitor.

Memory maps 110:Od and 110:Ev may be a set of dual port dynamic RAM assemblies which use MK4116s for receiving the edge data required to display alternate frames of 241 lines by 756 pixels. A "read-clear" feature may be incorporated for simultaneously clear each memory location to zero after each read.

Pixel clock 114 may be a 14.318 MHz oscillator for generating pixel clock pulses and the vertical and horizontal raster sync signals (V and H) required for establishing time registration throughout circuit 100 and with display device 106.

Zero loader 120 may be the clear input into the memory maps.

Color decoder 124 may be a 4-to-12 look-up table (three 74S189s) for providing 12 color control signals. D/A converters 128R, 128G, and 128B, may each be conventional devices for providing the video signals required by CRT 106.

Pipeline latch 130 may be a 12 flipflops (two 74LS173) commonly clocked to hold each decoded control signal.

Zero detector 134 may be a four input NOR gate (S260).

Timing device 136 may be a two input OR gate (S32) for synchronizing the changes in color control signals with the pixel clock.

GENERAL EMBODIMENT

Figure 2:
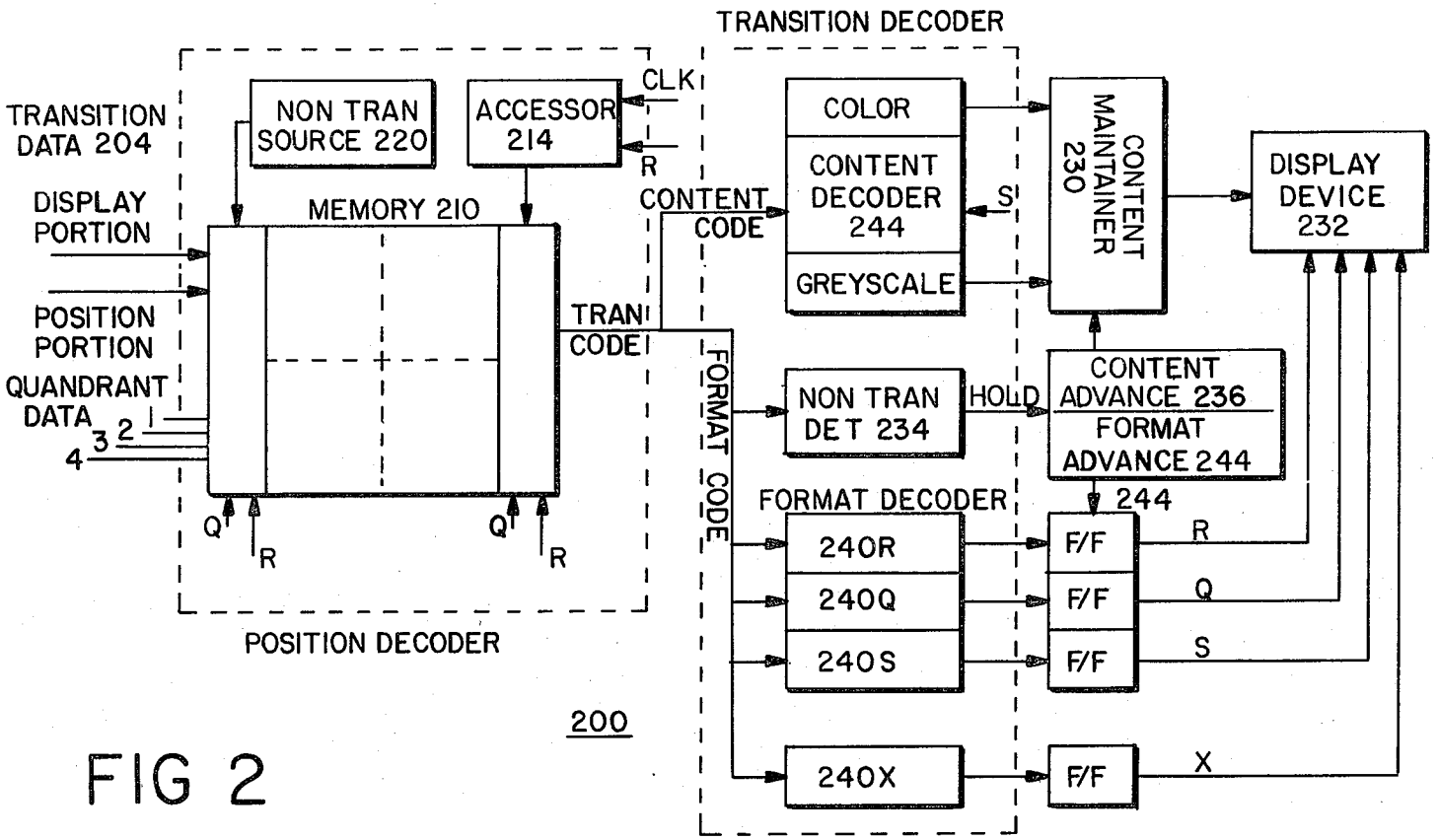
FIG. 2 is a block diagram of a general embodiment of a transition data decompressor with display format features.

FIG. 2 shows general embodiment 200 employing frame formating functions in addition to the pixel content codes and non-transition code of the FIG. 1 embodiment. Transition data 204 received by position decoder 208 to provide a stream of display data. Transition data 204 has a display portion (content pixel code and frame format code) and a position portion. The display portion is entered into memory 210 at a location determined by the associated position portion. Memory 210 is systematically accessed by accessor 214 to retrieve the display portion in the desired display sequence. The content codes are decoded by content decoder 224 to provide the visual effects of color and intensity (or greyscale) in the displayed image. Non-transition codes are generated by non-transition source 220 and appear between the content codes for prolonging the effect of each content code on display device 232. Non-transition detector 234, content advancer 236, and content maintainer 230 operate to prolong each content code during non-transition period.

The raster frame format codes control the format of the display image through a series of format decoders such as 240R (for controlling the resolution of the display), 240Q (for providing independent quadrant displays), and 240S (for shifting decoder 224 into the color or greyscale mode).

Resolution decoder 240R responds to resolution format codes from memory 210 by providing a resolution control voltage R to the peripheral reading circuitry of memory 210. The horizontal resolution may be decreased by decreasing the retrieval rate of accessor 214 versus the system pixel clock rate causing each location in memory 210 to represent more than one pixel in display 206. The vertical resolution may be decreased by recycling each scanline of data in memory 210 to form more than one display scanline.

Quadrant detector 240Q responds to quadrant format codes by providing a quadrant control voltage Q to the peripheral writing circuitry of memory 210. Four sources of transition data (Q1, Q2, Q3, and Q4) are entered into corresponding quadrants of memory 210 for simultaneous display as four independent images of lower resolution instead of a single image of higher resolution.

Shift detector 240S responds to shift format codes by providing the MSB into content decoder 224 causing pixel data stream 216 to address either the color section of decoder 224 or the greyscale section.

The format data may be maintained and advanced in a manner similar to the content data by suitable hardware such as flipflops 242 and format advancer 244.

Additional format features may be employed by dedicating the codes required to identify the feature and providing the detectors 240X and hardware necessary to control the display to effect the feature. The format codes may also function as non-transition codes for maintaining the spacing between sequencial content codes. Each format detector 240 provides a HOLD signal which is combined with the HOLD signal from non-transition detector 234 to prevent advancement into maintainer 230 during the non-transition periods.

The separation of format codes from content codes may be accomplished by more than one technic. In the "decoding" approach, a few of the transition codes are allocated to format codes and the remainder to content codes. Each transition code is simultaneously applied to both content decoder 224 and format decoder 240. In a "hardwired bit" version of the decoding approach, several bits of each transition word are allocated to format data and the remainder to content data. Alternatively, the first several bytes of each scanline in memory 210 may be reserved for format codes which control the format of the remainder of that scanline. Each transition code would then be forwarded to content decoder 224 or format decoder 240 on the basis of memory address.

CONCLUSION

It will be apparent to those skilled in the art that the objects of this invention have been achieved by entering transition data into a RAM as a function of the display position of the transition, and accessing the RAM to form pixel data stream in display sequence. Each unit of transition data is latched to maintain the transition in the display until the next unit of transition data is retrieved.

Clearly various changes may be made in the structure and embodiments shown herein without departing from the concept of the invention. For example, the content data may be applied to the display device directly from memory without the latching-decompression feature with only the format data latched, or vice versa. Display windows other than quadrants may be generated with the format control. Further, the features of the embodiments shown in the various Figures may be employed with the embodiments of the other Figures. Therefore, the scope of the invention is to be determined by the terminology of the following claims and the legal equivalents thereof.

I claim as my invention:

1. An image processor for providing control signals to a raster type display device in response to input transition data, each unit of transition data corresponding to a transition in the image to be processed and displayed, each unit of transition data including a display portion defining the change in display caused by that transition and a position portion defining the position of that transition within the display relative to the other transitions in the image, comprising:

position decoder responsive to the position portion of each unit of transition data for receiving the display portion thereof and providing a data stream of transition display codes in display sequence spaced by non-transition codes which define the non-transition period between sequencial transition display codes;

transition decoder responsive to the transition display codes in the data stream for providing a sequence of decoded control signals;

maintenance means for receiving each decoded control signal from the transition decoder and holding the control signal during the non-transition period between sequential transition display codes for maintaining the display of the current transition on the display device during the non-transition period;

detector responsive to the non-transition codes between sequential transition display codes in the data stream from the position decoder for providing a non-transition signal during the non-transition period between the sequential transition display codes; and advancing means responsive to the termination of the non-transition signal from the detector at the end of the non-transition period for causing the next decoded control signal from the transition decoder to advance into the maintenance means for controlling the display device until the next transition display code is decoded.

2. The image processor of claim 1, wherein the position decoder comprises:

a random access memory for receiving each unit of transition data and entering the display portion thereof at an address location within the random access memory determined by the position portion thereof.

3. The image processor of claim 2, wherein the position decoder further comprises:

accessing means for systematically retrieving the transition display codes and the non-transition codes from the random access memory to form the data stream.

4. The image processor of claim 3, wherein the position decoder further comprises:

non-transition code means for providing non-transition codes at the address locations within the random access memory that do not contain transition display codes.

5. The image processor of claim 4, wherein the non-transition code means periodically enters non-transition codes into the locations of the random access memory containing transition display codes for periodically eliminating the transition display codes from the memory means.

6. The image processor of claim 5, wherein the non-transition code means enters a non-transition code into each memory location of the random access memory at end of each raster frame of the display device.

7. The image processor of claim 3, wherein the random access memory is a memory map of the display area of the display device having a memory location for each pixel of the display raster, and the data stream is a pixel data stream.

8. The image processor of claim 7, further comprising a pixel clock for for maintaining synchronization between the image processor and the display device.

9. The image processor of claim 8, wherein the accessing means is responsive to the pixel clock for sequentially accessing the memory map to synchronize the pixel data stream from the memory map.

10. The image processor of claim 9, wherein the memory map has a plurality of sections for facilitating the display of the image.

11. The image processor of claim 10, wherein the plurality of sections of the memory map includes an odd section for storing the transition display codes and non-transition codes forming the odd raster frames of the display device, and an even section for storing the transition display codes and non-transition codes forming the even raster frames of the display device.

12. The image processor of claim 11, wherein the codes stored in the odd section of the memory map are accessed during the display of the odd frames while the even section of the memory map is receiving transition data, and the codes stored in the even section are accessed during the display of the even frames while the odd section is receiving transition data.

13. The image processor of claim 8, wherein the position portion of each unit of transition data is the address to a location in the memory map for storing the transition display portion of that unit of transition data.

14. The image processor of claim 13, wherein each address has a MSB part which indentifies the raster scanline of the transition display portion, and has a LSB part which indentifies the pixel within the raster scanline of the transition display portion.

15. The image processor of claim 8, wherein the maintenance means is responsive to the pixel clock pulses for receiving each decoded control signal in the sequence of control signals from the transition decoder.

16. The image processor of claim 15, wherein the advancing means isolates the maintenance means from the pixel clock pulses during the non-transition period in response to the non-transition signal from the detecter.

17. The image processor of claim 16, wherein the advancing means is a timing gate which is disabled by the non-transition signal for isolating the maintenance means from the pixel clock pulses, and which is enabled by the absence of the non-transition signal for permitting the maintenance means to receive the next control signal in response to the next pixel clock pulse.

18. The image processor of claim 17, wherein the maintenance means is a data latch device which receives data in response to the pixel clock pulses.

* * * * *